United States Patent [19]

Harding

[11] 4,002,148

[45] Jan. 11, 1977

[54] GRATE ASSEMBLY FOR A BOILER

[75] Inventor: Brian Harding, West Bromwich, England

[73] Assignee: Parkinson Cowan GWB Limited, Dudley, England

[22] Filed: Apr. 7, 1975

[21] Appl. No.: 565,534

[30] Foreign Application Priority Data

Apr. 11, 1974 United Kingdom ..... 16133/74

[52] U.S. Cl. ..... 122/149; 110/33; 110/165 R; 126/174

[51] Int. Cl.[2] ..... F22B 7/12; F23H 11/10

[58] Field of Search ..... 110/33, 37, 38, 165 R; 126/174, 175, 155; 122/149

[56] References Cited

UNITED STATES PATENTS

| | | | |
|---|---|---|---|
| 245,578 | 8/1881 | Straszer | 126/174 |
| 903,131 | 11/1908 | Elliott | 110/33 |
| 1,210,364 | 12/1916 | Reagan | 110/74 |
| 1,977,620 | 10/1934 | Brown | 110/165 |
| 2,108,394 | 2/1938 | Steinmuller | 110/165 |
| 3,262,429 | 7/1966 | Loebel | 122/149 |

*Primary Examiner*—Kenneth W. Sprague
*Attorney, Agent, or Firm*—Hibben, Noyes & Bicknell, Ltd.

[57] ABSTRACT

A grate assembly for a shell boiler comprising a fire bed supporting means including a first apertured support member and a second support member mounted for mutual relative movement between a first position in which the apertures in the first member are obturated by the second member and a second position in which the apertures are not obturated and drive means for causing relative movement between the first and second positions at a speed to permit passage of ash through the apertures whilst continuing to support the fire bed.

13 Claims, 11 Drawing Figures

GRATE ASSEMBLY FOR A BOILER

BACKGROUND OF THE INVENTION

This invention relates to a grate assembly for a boiler of the type known as a shell boiler, herein referred to as the type described, and comprising a tubular shell with its axis arranged horizontally with one or more furnace tubes extending inwardly from the front end of the shell with each furnace tube being mounted at its rear end in an opening in the front wall of a combustion chamber. The invention also relates to a boiler of the type described including a grate assembly.

SUMMARY OF THE INVENTION

An object of the present invention is to provide a grate assembly intended primarily, but not exclusively, for use in a boiler of the type described and constructed to permit of convenient disposal of ash. Another object of the invention is to provide a boiler of the type described having a grate assembly constructed to permit of convenient disposal of ash.

According to one aspect of the present invention we provide a great assembly comprising a fire bed supporting means including a first support member having a plurality of apertures extending therethrough and a second support member said members being mounted for mutual relative movement between a first position in which the apertures in the first member are obturated by the second member, and a second position in which the apertures are not obturated by the second member and a drive means for causing said relative movement between said first and second positions at a speed to permit passage of ash through the apertures whilst continuing to support a fire bed.

The first and second support members may each comprise a set of spaced apart elongate fire bars, the longitudinal axes of the bars extending transversely of the direction of said relative movement, the bars of one set being positioned below the bars of the other set and the bars of said one set being disposed between the bars of said other set when the members are in said first position and the bars of said one set lying directly below the bars of said other set when the members are in said second position.

The bars of said one set may be fixed relative to a support structure and the bars of said other set may be connected to the drive means for reciprocation from said first position to said second position and back to said first position.

According to another aspect of the present invention we provide a boiler of the type described including a grate assembly as described in the proceding three paragraphs positioned in the or each furnace tube.

An ash conveyor may be positioned in the furnace tube beneath the grate assembly and be operable to convey ash to a discharge point.

The or each furnace tube may be formed with an opening beneath the grate assembly at a position intermediate the front and rear ends of the tube and said conveyor means may convey ash to said opening whereby ash can fall through the opening and hence be discharged.

BRIEF DESCRIPTION OF THE DRAWINGS

The invention will now be described in more detail by way of example with reference to the accompanying drawings wherein.

DESCRIPTION OF THE PREFERRED EMBODIMENT

Figure 1:
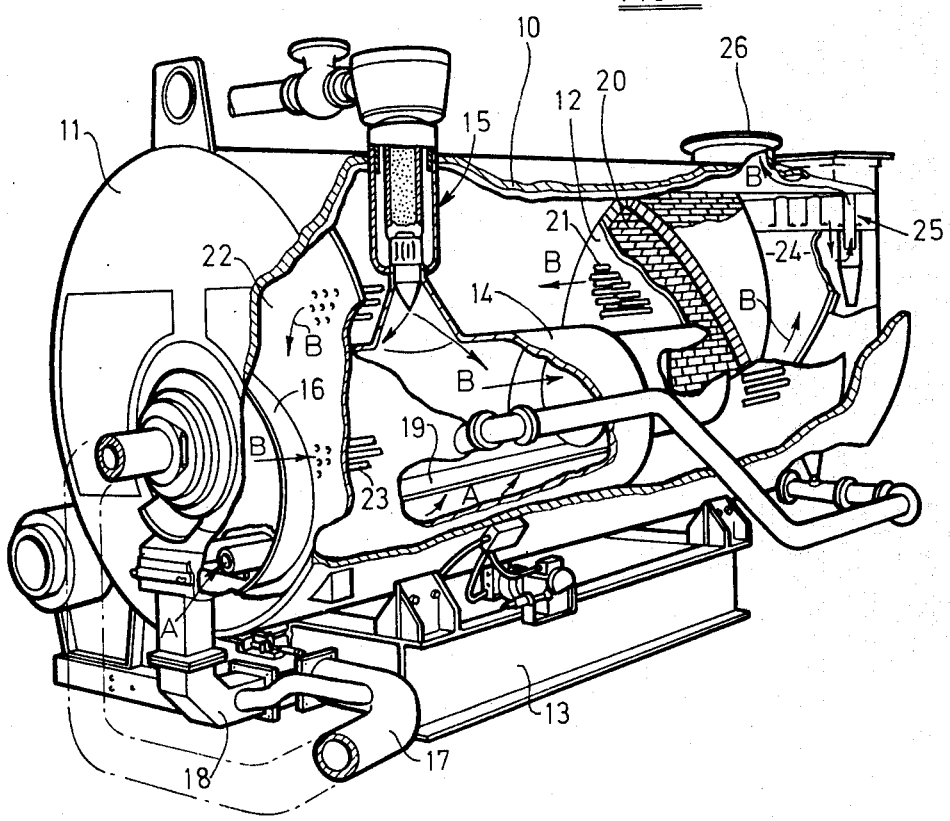
FIG. 1 is a perspective view partly broken away, of a boiler embodying the invention.

Referring to the drawings and in particular to FIG. 1 there is illustrated a solid fuel/oil fired "wet-back" shell boiler which comprises a cylindrical shell 10 with front and rear end plates 11 and 12 respectively and mounted on a base 13.

Positioned within the shell 10 is a furnace tube 14 of generally cylindrical form and to which solid fuel is fed through a conduit 15 which extends through the shell 10 into the furnace tube 14.

In the example under discussion the furnace tube is provided at its inlet end 16 with a nozzle of an oil burner, not shown, associated with a boiler air supply duct 17. Primary air is fed into the bottom of the furnace tube 14 through a duct 18 which branches from the duct 17, so as to pass up through the grate 19 as shown by the arrows A and to be described in more detail hereinafter.

The products of combustion pass from the furnace tube 14, as shown by the arrows B, into a reversing chamber 20 from which they pass through a series of smoke tubes 21 arranged parallel to the axis of the furnace tube 14 to a chamber 22 at the front of the boiler. There is a further series of smoke tubes 23 extending from the front of the boiler to a chamber 24 at the rear of the boiler and this chamber contains a grit arrester 25 for separating grit from the combustion products which then pass through a flue 26.

Figure 2:
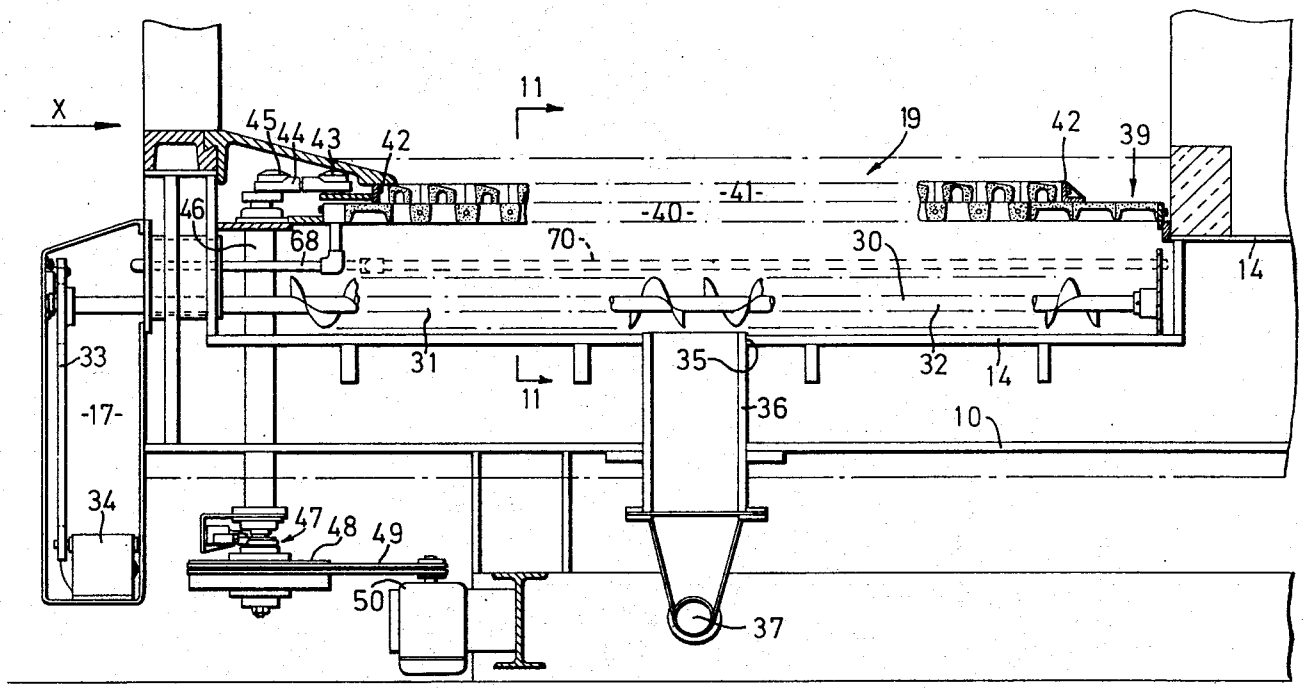
FIG. 2 is a side elevation, partly in section and to an enlarged scale through part of the boiler of FIG. 1.

Referring now particularly to FIG. 2, provided within the furnace tube 14 beneath the grate 19 are a pair of spaced parallel ash removing conveyor screws only one of which is shown at 30 in FIG. 2. The front part 31 of the screw shown in FIG. 2 has a left hand threaded whilst the rear part 32 has a right hand thread. The front part of the other screw conveyor has a right hand thread and the rear part a left hand thread. The conveyor screws 30 are arranged to be driven by a chain drive 33 from an electric motor 34.

Upon rotation of the screws, which are rotated in opposite directions by the chain drive, ash falling through the grate 19, as hereinafter to be described, is conveyed to a discharge point at which there is an opening 35 provided in the furnace tube 14 and through a downwardly extending tube 36 into a pneumatic ash removing duct 37.

The grate 19 is made in two halves. The right hand half, as viewed in the direction of the arrow X in FIG.

Figure 3:
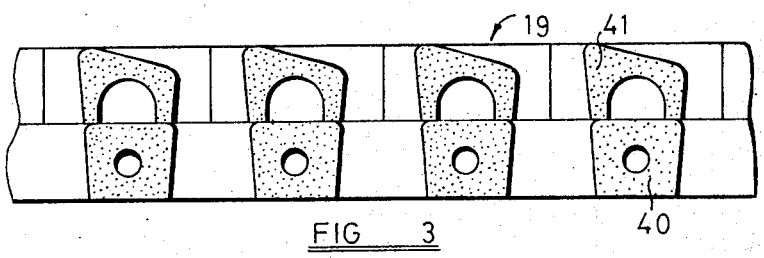
FIG. 3 is a scrap section through part of the grate of the boiler of FIG. 1 showing the grate in its open position.

2, is shown in its closed position in FIG. 2, whilst part of it is shown in its open position in FIG. 3. Part of the left hand half is illustrated in closed position in scrap section in FIG. 4.

Figure 11:
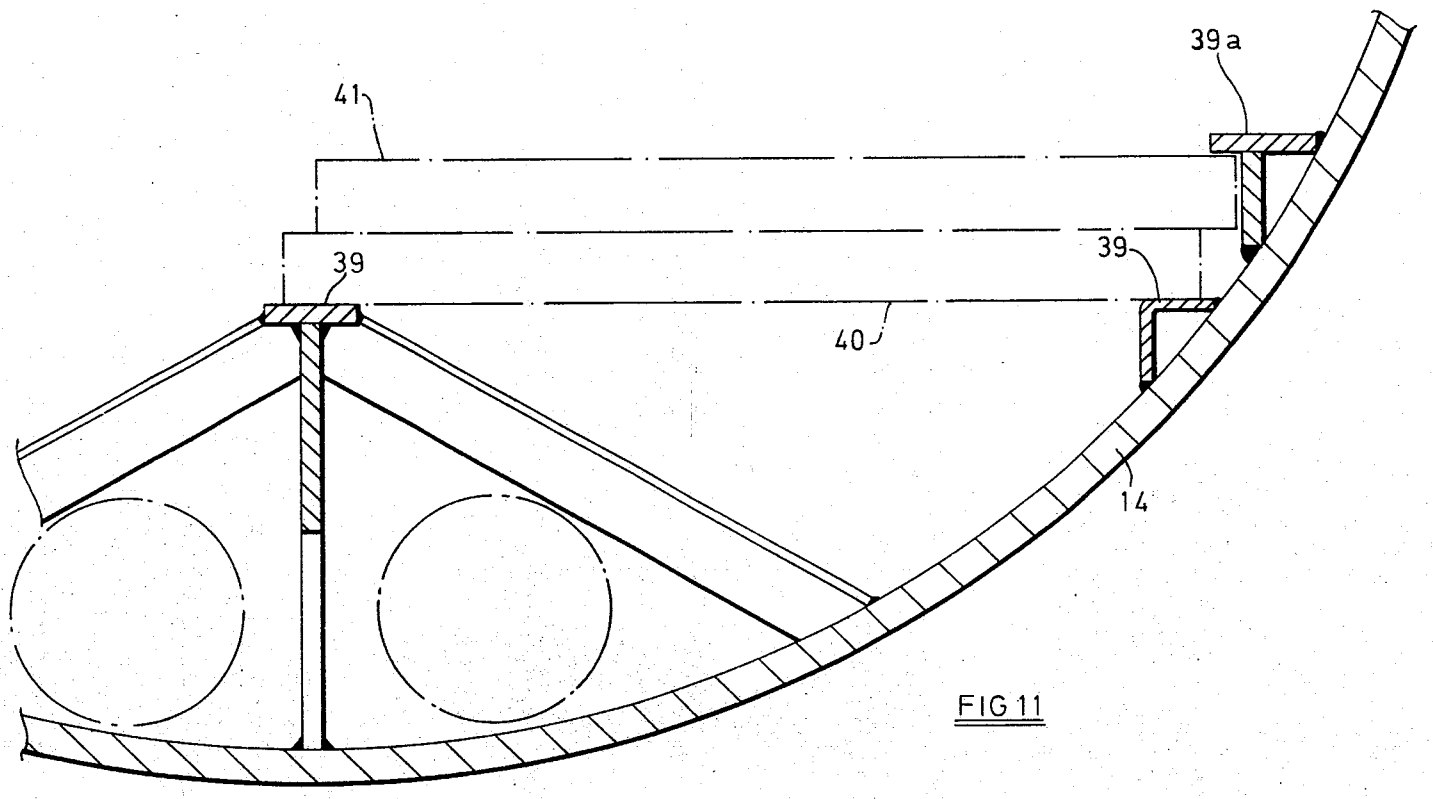
FIG. 11 is a section on the line 11—11 of FIG. 2.

The right hand grate comprises a lower set of fire bars 40 which are fixed relative to a support structure 39, see FIGS. 2 and 11, provided in the furnace tube 14 and an upper set of fire bars 41 which are mounted for longitudinal sliding movement relative to the fire bars 40 and are connected to a support assembly 42 slidably supported in the furnace tube 14 on guide rails 39*a*, see FIG. 11. The support structure 42 is connected by a pivot pin 43 to a connecting rod 44 mounted on an eccentric 45 on a shaft 46 driven through a clutch unit 47 from a fly wheel 48 which is driven through a belt drive 49 from an electric motor 50.

Figure 7:
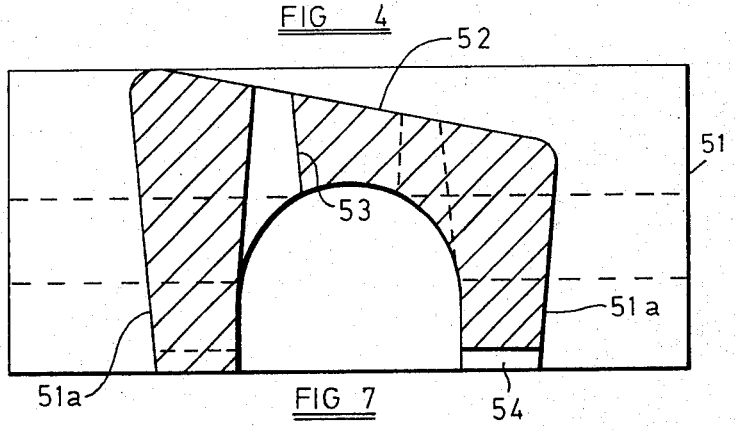
FIG. 7 is a section on the line 7—7 of FIG. 5.
Figure 5:
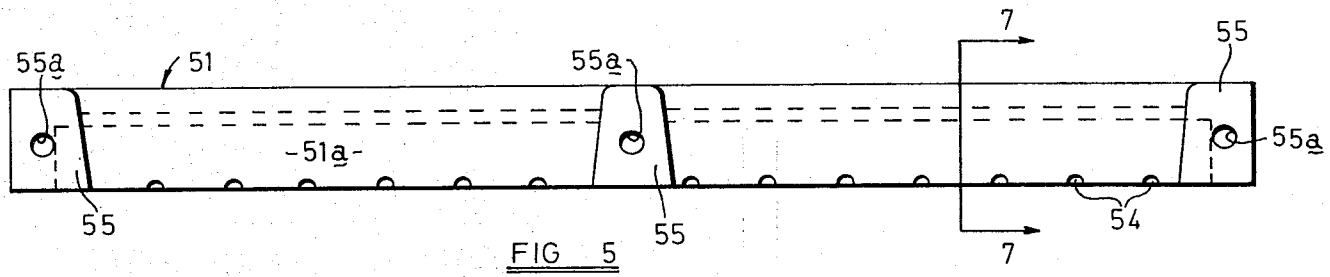
FIG. 5 is a side elevation of one of the upper fire bars of the grate assembly of the boiler of FIG. 1.
Figure 6:
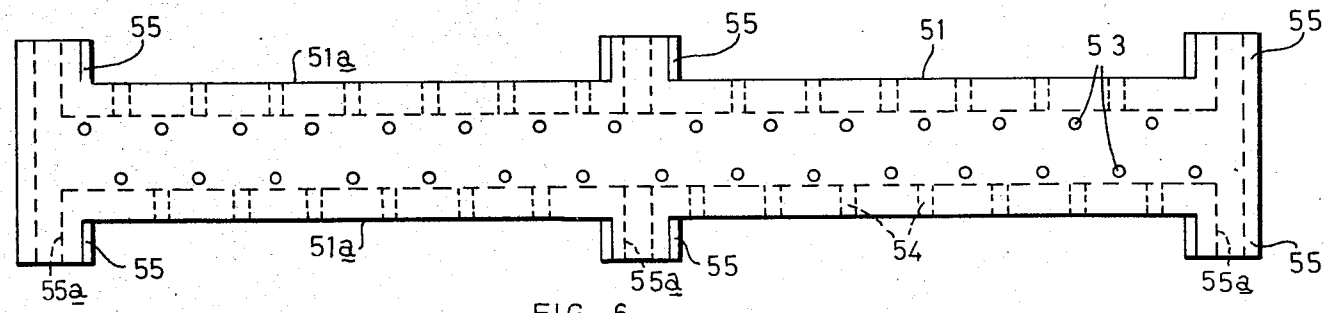
FIG. 6 is a plan view of the fire bar of FIG. 5.

Referring now particularly to FIGS. 5 to 7 each fire bar 51 of the upper set of fire bars 41 is of generally inverted channel section as best shown in FIG. 5 and includes downwardly and inwardly inclined side faces 51*a*, an inclined upper surface 52, tapered air supply passages 53 and semi-circular air supply slots 54 at the lower end of each side face 51*a*. The passages 53 are tapered so as to avoid clogging of the passages and the inclined surface 52 is provided so as to improve the scraping action of the fire bars as hereinafter to be described in more detail.

The fire bars 51 are provided with transversely extending mounting parts 55 for spacing the fire bars apart and tie rods, not shown, extend through bores 55*a* in the mounting parts 55 to connect them to the support structure 42.

Figure 10:
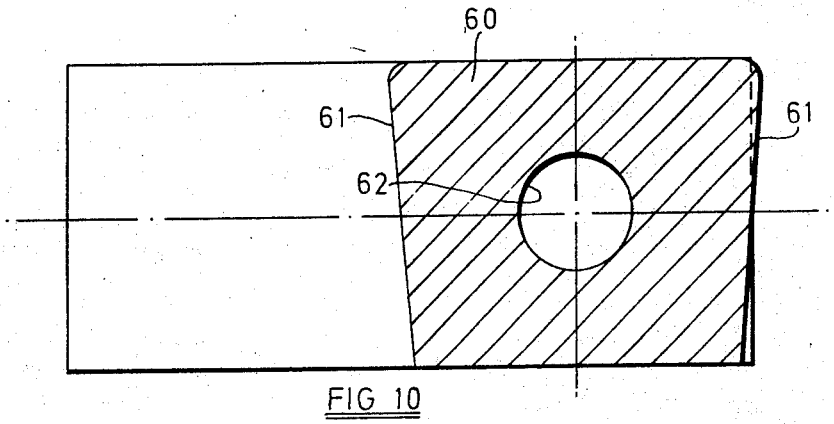
FIG. 10 is a section on the line 10—10 of FIG. 9.
Figure 8:
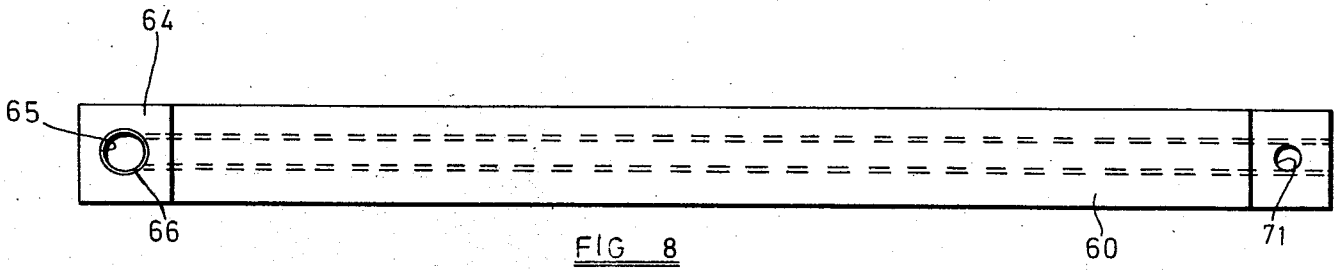
FIG. 8 is a side elevation of a lower fire bar of the grate assembly of the boiler of FIG. 1.
Figure 9:
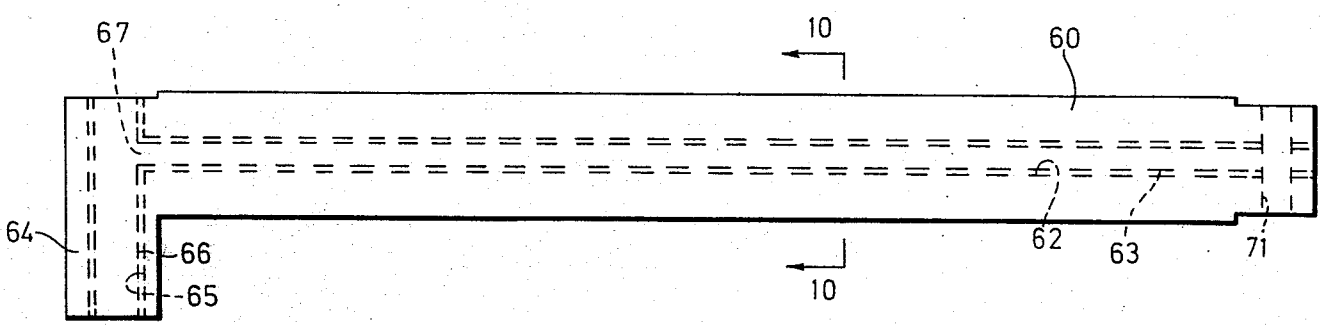
FIG. 9 is a plan view of the fire bar of FIG. 8.

The lower set of fire bars 40 comprise, referring to FIGS. 8 to 10, a plurality of bars 60 of generally rectangular configuration in cross section but having downwardly and inwardly inclined side faces 61, which, like the inclined side faces 51*a* of the upper fire bars are provided to prevent or to reduce the possibility of ash clogging between the bars.

Each bar 60 is provided with a longitudinally extending passageway 62 within which is received a steel insert 63 which defines a passageway for steam. At one end each bar 60 is provided with a head portion 64 in which is formed a transversely extending passageway 65 in which a further, steel tube insert 66 is engaged having an opening 67 for communication with the interior of the type 63. At the other end of the bar the passageway 62 is closed, by means not shown. At spaced intervals along the length of the fire bar are provided transversely extending passages, not shown, which communicate with the side surfaces 61 of the bar and which are arranged so as to be staggered in adjacent fire bars.

Steam is supplied to the tube 66 through a manifold 68 see FIG. 2. A steam lance 70 is also provided in the furnace tube 14 beneath the grate 19.

The bars 60 are connected together and to the support structure 39 by tie rods which extend within the tube 66 and a passage 71 at the other end of the bar.

Figure 4:
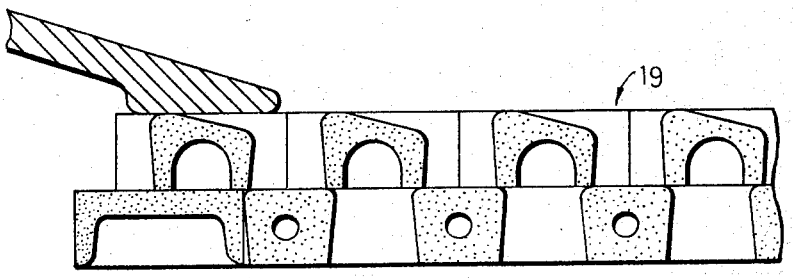
FIG. 4 is a scrap section through another part of the grate of the boiler of FIG. 1 showing the grate in its closed position.

The left hand grate, partly shown in FIG. 4 is similar in construction to the right hand grate except that, as shown in FIGS. 2 and 4 the position of the upper and lower fire bars is staggered.

In use, the furnace is operating with solid fuel fed through the supply conduit 11 the fuel falls onto the grate 19 and forms a fire bed which burns thereon.

When it is desired to de-ash the fire bed and this may be done at predetermined intervals for example, after a predetermined number of rotations of the solid fuel supply screw. Firstly, the motor 50 is energised to drive the fly wheel 48 up to the desired speed of rotation. The primary air supply fan is switched off at the same time. The reason for this is that when the upper and lower sets of fire bars are operated so as to open the grate it is desirable to restrict the air flow therethrough as otherwise the fire would be blown out through the thus formed openings.

The clutch 47 is then operated to cause the upper set of fire bars 41 to be reciprocated from the closed position shown in FIG. 2 to the open position shown in FIG. 3 and back to the closed position.

This reciprocatory movement causes a slice of ash to be scraped from the bottom of the fire bed, the inclined surfaces 52 of the upper fire bars 50 facilitating the slicing of a predetermined thickness of ash from the base of the fire bed and the ash is permitted to fall through the openings formed when the upper set of fire bars 41 is moved to the left, in FIG. 2, so that they temporarily do not obturate the openings between the lower fire bars. The speed of the reciprocation is adjustable and permits adjustment of the amount of ash removed but is in all cases sufficiently fast so that whilst ash is removed the fire bed is not distributed and so that the fire bed does not pass through the openings formed in the grate. A typical speed of reciprocation is at the rate of 140 cycles per minute. It is envisaged that only a single cycle would be performed for each de-ashing operation but if desired one or more cycles may be performed.

After the cycle has been completed the primary air supply fan is again energised and the motor so de-energised. The ash conveyor screws 30 and then rotated to convey the ash to the discharge opening 35 and hence to fall through the tube 36 into the pneumatic ash removal duct 37.

During operation of the furnace steam is fed into the fire bed through the manifold 68 and passageways described hereinbefore in the lower fire bars 60 and also, if desired, through the steam lance 70. This prevents clinker formation in the fire bed as the steam reacts with the carbon to form carbon monoxide which is an endothermic reaction and so cools the fire and in addition causes physical cooling of the fire. Because the temperature of the fire is thus lowered clinkering is prevented and this is important because the ash removing device of the present invention does not facilitate removal of slab clinker, i.e. clinker of the size greater than that which will pass through the space between the bars of the grate.

Although the invention has been described applied to a solid fuel oil fired boiler it may be applied to any boiler or other apparatus having a solid fuel fire.

I claim:

1. A grate assembly comprising a fire bed supporting means including a first support member having a plurality of apertures extending therethrough and a second support member, said members being mounted for mutual relative movement between a first position in which the apertures in the first member are obturated by the second member, and a second position in which the apertures are not obturated by the second member, a drive means for causing said relative movement between said first and second positions at a speed to permit passage of ash through the apertures whilst continuing to support a fire bed and wherein one of the support members is provided with air feed passageways whereby air may be fed to a firebed supported on said means.

2. A grate assembly according to claim 1 wherein the first and second support members each comprise a set of spaced apart elongate fire bars, the longitudinal axes of the bars extending transversely of the direction of said relative movement, the bars of one set being positioned below the bars of the other set and the bars of said one set being disposed between the bars of said other set when the members are in said first position and the bars of said one set lying directly below the bars of said other set when the members are in said second position.

3. A grate assembly according to claim 2 wherein the bars of said one set are fixed relative to a support structure and the bars of said other set are connected to the drive means for reciprocation from said first position to said second position and back to said first position.

4. A grate assembly according to claim 2 wherein the bars of said other set are provided with air feed passageways, the bars of said other set are of inverted channel section, said air feed passageways extend from the external upper and side surfaces of each bar to the channel thereof, and the air feed passageways which extend from the external upper face extend vertically downwardly and are of tapered configuration having a smaller cross-section at their upper end.

5. A grate assembly according to claim 4 wherein the passageways which extend from the side faces extend horizontally and are in the form of grooves in the undersurface of the side walls of the channel section fire bar.

6. A grate assembly comprising a firebed supporting means including a first support member having a plurality of apertures extending therethrough and a second support member, said members being mounted for mutual relative movement between a first position in which the apertures in the first member are obturated by the second member, and a second position in which the apertures are not obturated by the second member, a drive means for causing said relative movement between said first and second positions at a speed to permit passage of ash through the apertures whilst continuing to support a fire bed and wherein one of the support members is provided with steam feed passageways whereby steam may be fed to a fire bed supported on said means.

7. A grate assembly according to claim 6 wherein the first and second support members are comprise a set of spaced apart elongate fire bars, the longitudinal axes of the bars extending transversely of the direction of said relative movement, the bars of one set being positioned below the bars of the other set and the bars of said one set being disposed between the bars of said other set when the members are in said first position and the bars of said one set lying directly below the bars of said other set when the members are in said second position.

8. A grate assembly according to claim 7 wherein the bars of said one set are provided with steam feed passageways, the bars of said one set have a longitudinally extending bore and said steam feed passageways extend from said bore to the side face of the bars.

9. A grate assembly comprising a fire bed supporting means including first and second support members mounted for mutual relative movement and wherein said support members each comprise a set of spaced apart elongate fire bars, the longitudinal axes of the bars extending transversely of the direction of said relative movement, the bars of one set being positioned below the bars of the other set and the bars of said one set being disposed between the bars of said other set when the members are in a first relative position and the bars of said one set lie directly below the bars of said other set when the members are in a second relative position, there being a drive means for causing said relative movement between said first and second positions at a speed to permit passage of ash through the apertures between the bars whilst continuing to support a fire bed and wherein the bars of each set have inclined adjacent side faces whereby the separation between said faces is least at the top face of the bars.

10. A grate assembly comprising a fire bed supporting means including a first and second support members mounted for mutual relative movement and wherein said support members each comprise a set of spaced apart elongate fire bars, the longitudinal axes of the bars extending transversely of the direction of said relative movement, the bars of one set being positioned below the bars of the other set and the bars of said one set being disposed between the bars of said other set when the members are in a first relative position and the bars of said other set when the members are in a second relative position, there being a drive means for causing said relative movement between said first and second positions at a speed to permit passage of ash through the apertures between the bars whilst continuing to support a fire bed and wherein the top face of the bars of said other set are inclined to the horizontal so that the higher stage of the bars is the leading edge at the beginning of movement from said first to said second position.

11. A shell boiler comprising a tubular shell with its axes arranged horizontally with at least one furnace tube extending inwardly from the front end of the shell with each furnace tube being mounted at its rear end in an opening in the front wall of a combustion chamber including, positioned in each furnace tube, a grate assembly comprising a fire bed supporting means including a first support member having a plurality of apertures extending therethrough and a second support member, said members being mounted for mutual relative movement between a first position in which the apertures in the first member are obturated by the second member, and a second position in which the apertures are not obturated by the second member and a drive means for causing said relative movement between said first and second positions at a speed to permit passage of ash through the apertures whilst continuing to support a fire bed and wherein one of the support members is provided with a feed passageway whereby air may be fed to a fire bed supported on said means.

12. A boiler according to claim 11 wherein an ash conveyor is positioned in the or each furnace tube beneath the grate assembly and is operable to convey ash to a discharge point.

13. A boiler according to claim 12 wherein the or each furnace tube is formed with an opening beneath the grate assembly at a position intermediate the front and rear ends of the or each tube and said conveyor means is operable to convey ash to said opening whereby ash can fall through the opening and hence be discharged.

* * * * *